US005851567A

United States Patent [19]

Proni

[11] Patent Number: 5,851,567

[45] Date of Patent: Dec. 22, 1998

[54] EARTH BLOCK MACHINE

[75] Inventor: Oscar Proni, Hollywood, Fla.

[73] Assignee: Earth-Block International Corporation, Miami, Fla.

[21] Appl. No.: 814,786

[22] Filed: Mar. 10, 1997

[51] Int. Cl.[6] ..... B28B 3/06

[52] U.S. Cl. ..... 425/346; 425/412; 425/457

[58] Field of Search ..... 425/346, 412, 425/451.5, 451.6, 457

[56] References Cited

U.S. PATENT DOCUMENTS

| | | | |
|---|---|---|---|
| 1,542,341 | 6/1925 | Deckert . | |
| 1,592,355 | 7/1926 | Gassmann | 425/346 |
| 1,814,227 | 7/1931 | Parry | 425/412 |
| 1,864,769 | 11/1932 | Slidell | 425/100 |
| 2,265,771 | 12/1941 | Davis | 425/62 |
| 2,388,679 | 11/1945 | Davis | 264/241 |
| 2,524,683 | 10/1950 | Sumpf | 425/62 |
| 2,537,920 | 1/1951 | Smith | 425/556 |
| 2,565,155 | 8/1951 | Westin | 425/412 |
| 2,580,487 | 1/1952 | Vigmostad | 296/117 |
| 2,606,676 | 8/1952 | Dempster | 214/77 |
| 2,616,144 | 11/1952 | Adam | 425/346 |
| 2,870,514 | 1/1959 | Ebersole | 425/346 |
| 2,893,101 | 7/1959 | Britner et al. | 425/412 |
| 2,943,498 | 7/1960 | Smith | 74/106 |
| 3,142,105 | 7/1964 | Weir et al. | 425/62 |
| 3,196,700 | 7/1965 | Gron | 74/110 |
| 3,225,409 | 12/1965 | Huffaker | 425/209 |
| 3,496,257 | 2/1970 | Brown et al. | 425/346 |
| 3,648,600 | 3/1972 | Jaccard | 425/346 |
| 3,677,687 | 7/1972 | Siegfried et al. | 425/412 |
| 3,776,681 | 12/1973 | Neil | 425/346 |
| 3,844,209 | 10/1974 | Allbritton | 100/100 |
| 4,048,004 | 9/1977 | Watkins | 156/580.1 |
| 4,153,404 | 5/1979 | Ottman | 425/256 |
| 4,167,435 | 9/1979 | Olschewski | 156/583.1 |
| 4,453,455 | 6/1984 | Bergstrand | 92/117 A |
| 4,579,706 | 4/1986 | Elkins | 264/124 |
| 4,800,767 | 1/1989 | Abrahamson | 74/38 |
| 4,833,972 | 5/1989 | Bohusch et al. | 91/465 |
| 5,587,187 | 12/1996 | Benade | 425/412 |

*Primary Examiner*—James P. Mackey

*Attorney, Agent, or Firm*—Jacobson, Price, Holman & Stern, PLLC

[57] ABSTRACT

An earth block machine including opposed compaction chambers each receiving a reciprocal compacting member to form solid building blocks by compacting soil. The compacting members are reciprocated by a hydraulically actuated mechanical leverage system connected to the compacting members to produce a very high compaction force while employing a relatively low hydraulic pressure. Each compaction chamber includes a vertically spaced and aligned inlet and outlet provided with a hydraulically powered openable and closable plate to enable inlet of a quantity of soil into the compaction chamber from a supply bin and discharge of the formed earth block from the compaction chamber.

21 Claims, 4 Drawing Sheets

EARTH BLOCK MACHINE

BACKGROUND OF THE INVENTION

1. Field of the Invention

This invention relates to an earth block machine including opposed compaction chambers each receiving a reciprocal compacting member to form solid building blocks by compacting soil. The compacting members are reciprocated by a hydraulically actuated linkage mechanism connected to the compacting members to produce a very high compaction force while employing a relatively low hydraulic pressure. Each compaction chamber includes a vertically spaced and aligned inlet and outlet provided with a hydraulically powered openable and closable plate to enable inlet of a quantity of soil into each compaction chamber from a supply bin and discharge of the formed earth blocks from the compaction chambers.

2. Description of the Prior Art

Earth block or adobe building blocks have been used in the construction of various buildings for many years and continue to be an important building material. Original adobe block construction involved the positioning of a slurry material in a mold and letting it dry and cure for an extended period of time. Over the years, various machines have been provided for compacting soil into earth blocks which can be stacked as walls and floors for any kind of structure without the use of mortar or other type of binder material to lock the blocks together. Also, various types of presses have been developed for compressing or compacting various materials.

The following U.S. patents disclose various developments in earth block machines and presses for various purposes.

| | | |
|---|---|---|
| 1,864,769 | 2,524,683 | 3,225,409 |
| 2,265,771 | 2,537,920 | 4,153,404 |
| 2,388,679 | 3,142,105 | 4,579,706 |

A number of block machines have been patented and built since the 1930s. Few are still on the market. The first ones had mobility but they were repeating the technologies of the time: mixture of the material with water and dropping the same in forms having the block size. In most, the blocks were dried by the sun (see U.S. Pat. Nos. 1,864,769, 2,524,683 and 3,142,105).

One of the first machines using a hydraulic press of 1000 psi is described in U.S. Pat. No. 2,265,771. The mold is made of disassembling plates which makes it easier to charge and discharge the machine. The same inventor patented an advanced machine producing various shaped blocks (U.S. Pat. No. 2,388,679).

These machines started to use ordinary soil. The block machine described in U.S. Pat. No. 3,225,409, by using a ram to compress the soil, tries to produce more blocks per cycle. A continuous supply of soil is described in U.S. Pat. No. 4,153,404. The soil flow is governed by retaining plates which open at the proper time.

The block machine described in U.S. Pat. No. 4,579,706 also uses the direct force of a ram to compress soil supplied through a bin. To increase production, two molds are used, one on each side of a cylinder end. The rod, protruding out of the cylinder ends, controls the compressing blocks of each mold. The compression of the soil is done in sequence. All the ram machines described above use the ram directly on the soil to be compressed. For this reason, the hydraulic pressure in the rams is very high. This results in after-shock problems.

The above patents disclose various types of presses including machines for making earth blocks or adobe blocks including rams which are directly actuated by a piston rod aligned with a pressure operated cylinder with the ram being reciprocally received in a compaction chamber or mold. Such direct application of force by the pressure operated cylinder requires extremely high fluid pressure in order to obtain an adequate compacting or compressing force on the ram. The prior art does not disclose an arrangement in which opposed rams are actuated by fluid pressure actuated linkage mechanisms having a unique force increasing relationship with the rams and an assembly applying hydraulically actuated force to the linkage mechanisms.

SUMMARY OF THE INVENTION

This invention is an energy saving mobile machine allowing for high volume production of compressed soil into earth blocks which can enable construction of truly affordable housing. This invention, by using on-site soil to produce the blocks, not only saves energy in the production process but also in all related uses of the blocks. This invention eliminates the need for construction of a factory, truck loading of the blocks, transportation to the construction site and unloading of the blocks all of which contribute heavily to the depletion of energy. This invention will produce blocks which require no mortar or any other type of binder to lock the blocks together. This invention addresses the needs of worldwide low cost housing, emergency military quarters and other low cost structures. This invention requires less energy to produce its product than any other form of block technology and provides the quickest and least expensive type of construction. Building materials such as wood, which in developing countries requires forest destruction, adversely impact the environment and require vast amounts of energy for reforestation. This invention will produce blocks with a potential life span equaling or exceeding that of all existing building materials, in addition to being 100% recyclable, and have less impact on the environment than any other building material extracted from the earth.

One advantage of this earth block machine over other soil compacting machines on the market is its ability to achieve high compaction with low hydraulic psi. Current machines require hydraulic pressure of 4000 to 5000 psi to drive their ramming systems which causes constant breakdowns within the hydraulic mechanism. In contrast, this invention's hydraulic system will operate at 750 psi. This low hydraulic pressure in turn will drive a leverage ramming system which will compress the blocks at approximately 3000 psi. The leverage ramming system contrasts with the direct hydraulic force used by current machines to drive the ramming system. This invention, by using a leverage system, is not impacted by the perpetual stress experienced by the other block machines using direct hydraulic ramming. The current block machines on the market produce between 300 to 400, 12"×10"×4", blocks per hour. This invention will produce 1200 or more 12"×10"×4" blocks per hour achieving a compressive resistance as high or higher than that of the other machines.

The positive energy impact of this invention is twofold. First, the production of blocks to be manufactured by this invention will use less energy than current block machines. Second, this invention has a dual ramming system which uses the same amount of energy as the single ramming system of other machines, while tripling production of the other machines thereby reducing the energy to produce one block by 66%. In addition to this twofold energy saving in the manufacturing process, there are substantial savings from the elimination of transportation of blocks from the manufacturing source to the construction site. Many areas suitable for large scale, low cost, housing projects and areas where emergency military quarters are needed, are long distances from a manufacturing source. This often requires transporting high volumes of building materials hundreds of miles. This invention eliminates this need of transporting blocks, resulting in major energy savings. One further source of energy saving would be the exceptional insulation qualities provided by earth blocks.

Adobe building blocks have been used in construction for thousands of years. Throughout North and South America, Africa, the Middle East and other parts of the world, adobe blocks continue to be an important building material. The invention takes the ancient adobe method of making blocks to a state of the art technology. The invention eliminates the weeks and months of curing time required by conventional adobe blocks. As quickly as the invention produces blocks, the blocks can be stacked as walls and floors for any kind of structure.

Block manufacturing plants are normally located in places where the prime raw material is abundant and easy to obtain. The blocks are then transported to the place of use, in many cases hundreds of miles. This invention eliminates the cost of transportation, thereby saving vast amounts of fuel by fabricating the blocks at the place of use. Thus, every building site becomes an instantaneous block factory.

There are several block machines on the market that produce blocks at the place of use. However, these machines have severe problems caused by the constant high pressure of the fluid used in their hydraulic system. In addition, the aftershock caused by releasing the high pressure during their working cycle is very deleterious. These adverse effects reduce the effective working time of the machines by over 60%. The mean pressure used by these machines is 5000 psi. The machine of this invention uses a pressure of only 750 psi and compresses the soil at a higher pressure. This is made possible through the use of a mechanical leverage system driven by a low-pressure hydraulic system. This machine compresses soil at up to 3000 psi and thus obtains a solid block which is better than the blocks obtained with the traditional method.

Accordingly, an object of the present invention is to provide an earth block machine utilizing opposed compaction chambers or molds and opposed compacting members or rams reciprocal in relation to the compacting chambers with a hydraulically actuated power mechanism connected to the compacting members by a mechanical leverage system that enables an extremely high compaction or compression pressure to be exerted on soil in the compaction chambers while using a reduced hydraulic pressure.

Another object of the invention is to provide an earth block machine in accordance with the preceding object in which the hydraulic mechanism includes a pair of opposed generally aligned hydraulic piston and cylinder assemblies with the piston of each of the assemblies being connected to a pair of links which move the opposed compacting members in a reciprocal manner in relation to the compacting chambers.

A further object of the invention is to provide an earth block machine in accordance with the preceding objects in which each of the compaction chambers includes a vertically spaced inlet opening and outlet opening in which the inlet openings are communicated with a supply bin for soil to be compressed into a solid building block.

Still another object of the invention is to provide an earth block machine in accordance with the preceding objects in which the inlets and outlets are opened and closed by sliding plates actuated by hydraulically powered piston and cylinder assemblies operated independently of the piston and cylinder assemblies for reciprocating the compacting members.

Another significant object of this invention is to provide an earth block machine that is hydraulically operated to compress soil at a very high pressure until the soil becomes a solid building block with the soil to be compressed being supplied from a supply bin into a pair of opposed, aligned and spaced compaction chambers each of which receives a reciprocal compacting member with the compacting members being in opposed aligned relation and connected to a pair of links at their proximal ends with the links converging and pivotally connected to the piston of one of a pair of opposed hydraulically operated piston and cylinder assemblies whereby the links will be moved from a position in acute angular relation to each other to a position substantially in alignment with each other to move the compacting members in a reciprocal manner with the pivotal movement of the links providing an increasing force to the compacting members as they move from an acute angular converging relation to a substantially aligned relation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
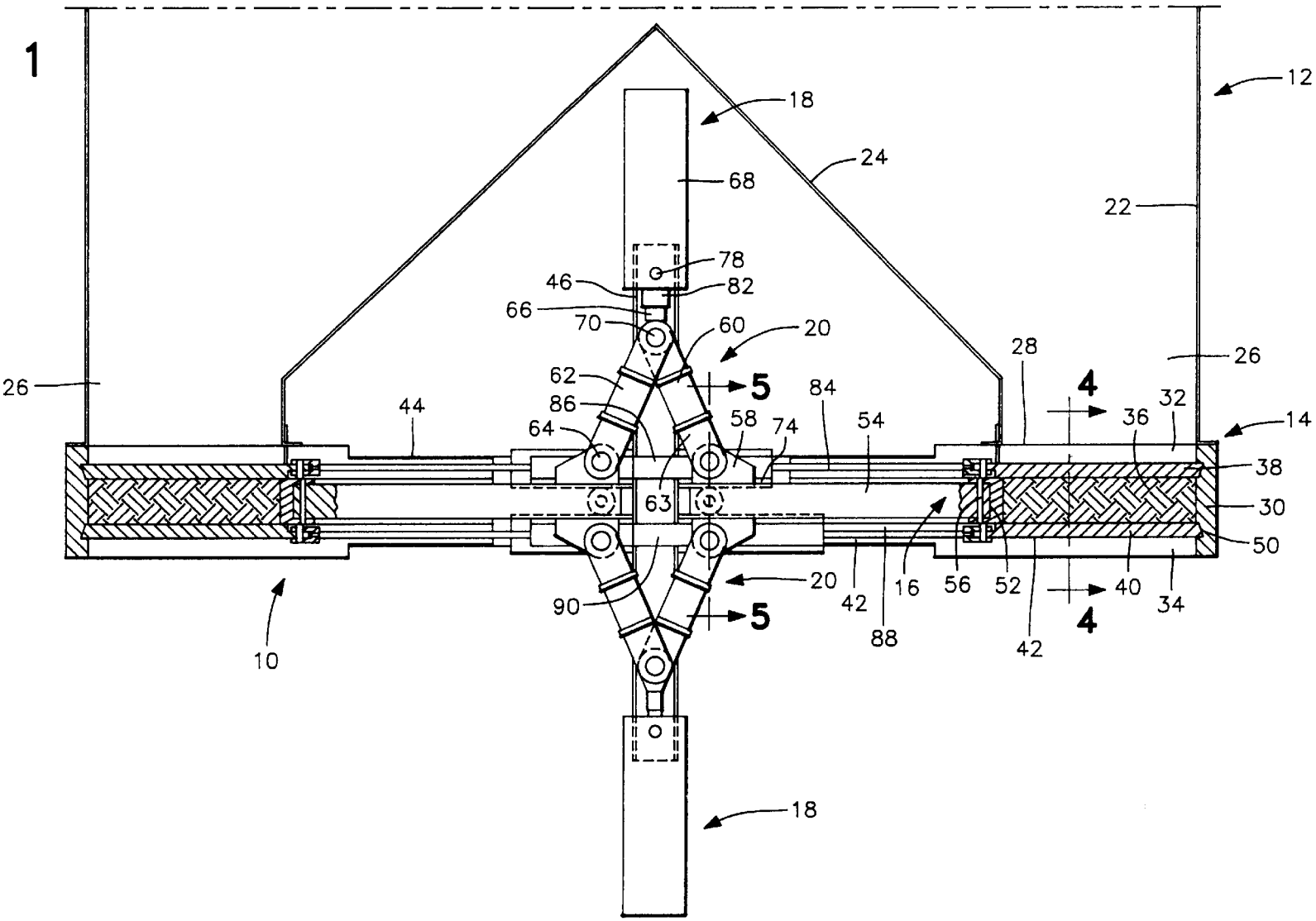
FIG. 1 is a vertical sectional view of the earth block machine of the present invention illustrating the relationship of the components of the machine.

In describing the preferred embodiment of the present invention as illustrated in the drawings, specific terminology will be resorted to for the sake of clarity. However, the invention is not intended to be limited to the specific embodiment illustrated and terms so selected; it being understood that each specific term includes all technical equivalents which operate in a similar manner to accomplish a similar purpose.

Referring specifically to the drawings, the earth block machine of the present invention is generally designated by reference numeral 10 and includes a vertically disposed supply bin 12 receiving a quantity of soil to be compressed into solid earth blocks for use as building blocks in constructing any suitable type of building, housing or the like. The earth block machine includes a pair of opposed, horizontally disposed, aligned compaction chambers generally designated by reference numeral 14 each of which reciprocally receives a compacting member or ram generally designated by reference numeral 16 that is reciprocated by a hydraulically powered assembly generally designated by reference numeral 18 with a mechanical leverage system generally designated by numeral 20 interconnecting the hydraulically powered assembly 18 and the compacting members 16.

Figure 2:
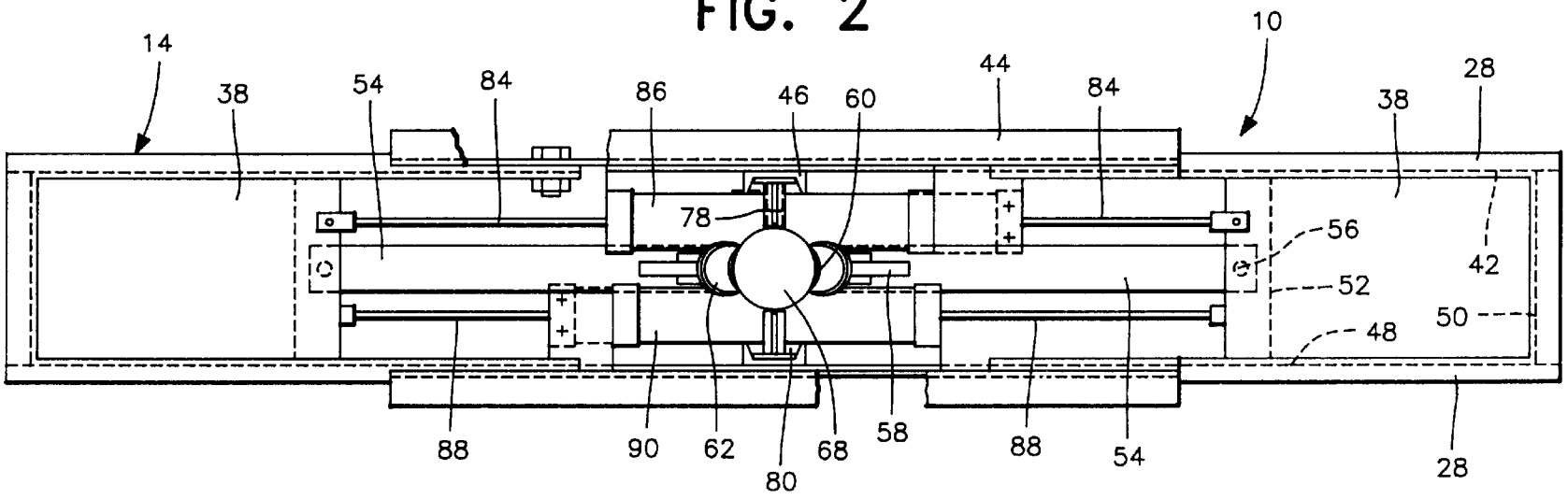
FIG. 2 is a top plan view of the machine with the supply bin removed illustrating the structural details of the components.
Figure 3:
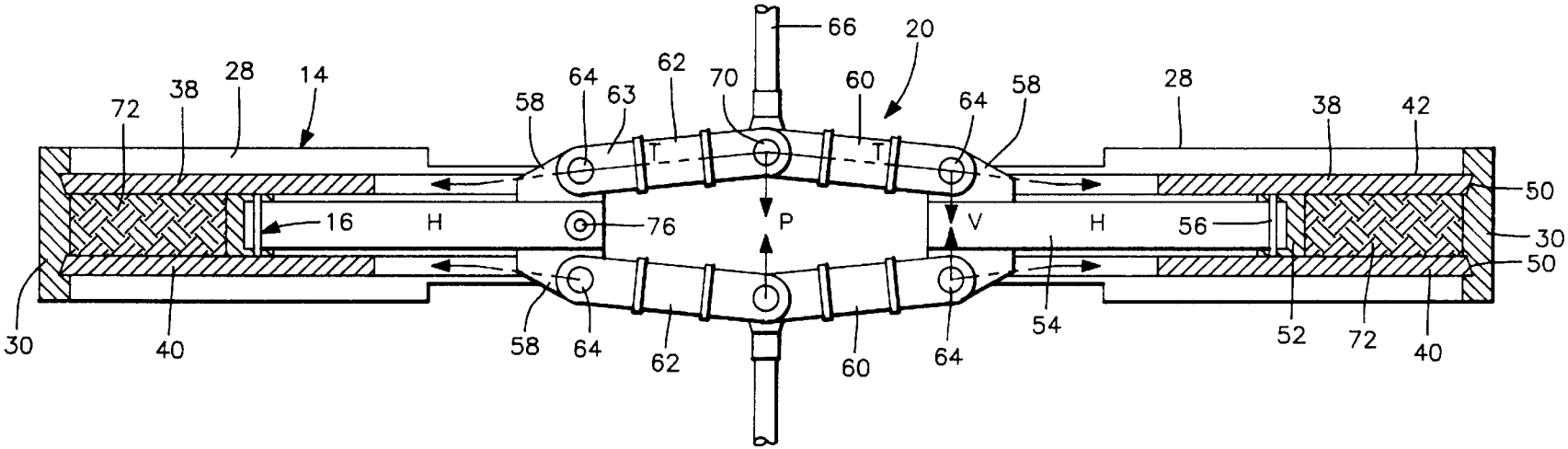
FIG. 3 is a schematic sectional view similar to FIG. 1 with the supply bin and piston and cylinder assemblies actuating the links being removed and the rams in extended position.
Figure 4:
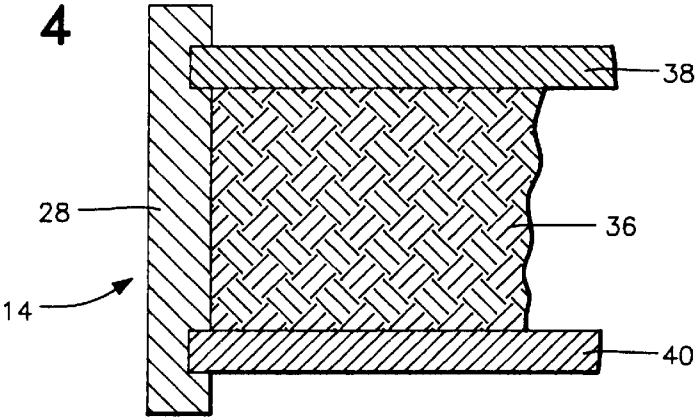
FIG. 4 is a transverse, sectional view on an enlarged scale, of one side wall of the compaction chamber and closure plates for the inlet and outlet.
Figure 5:
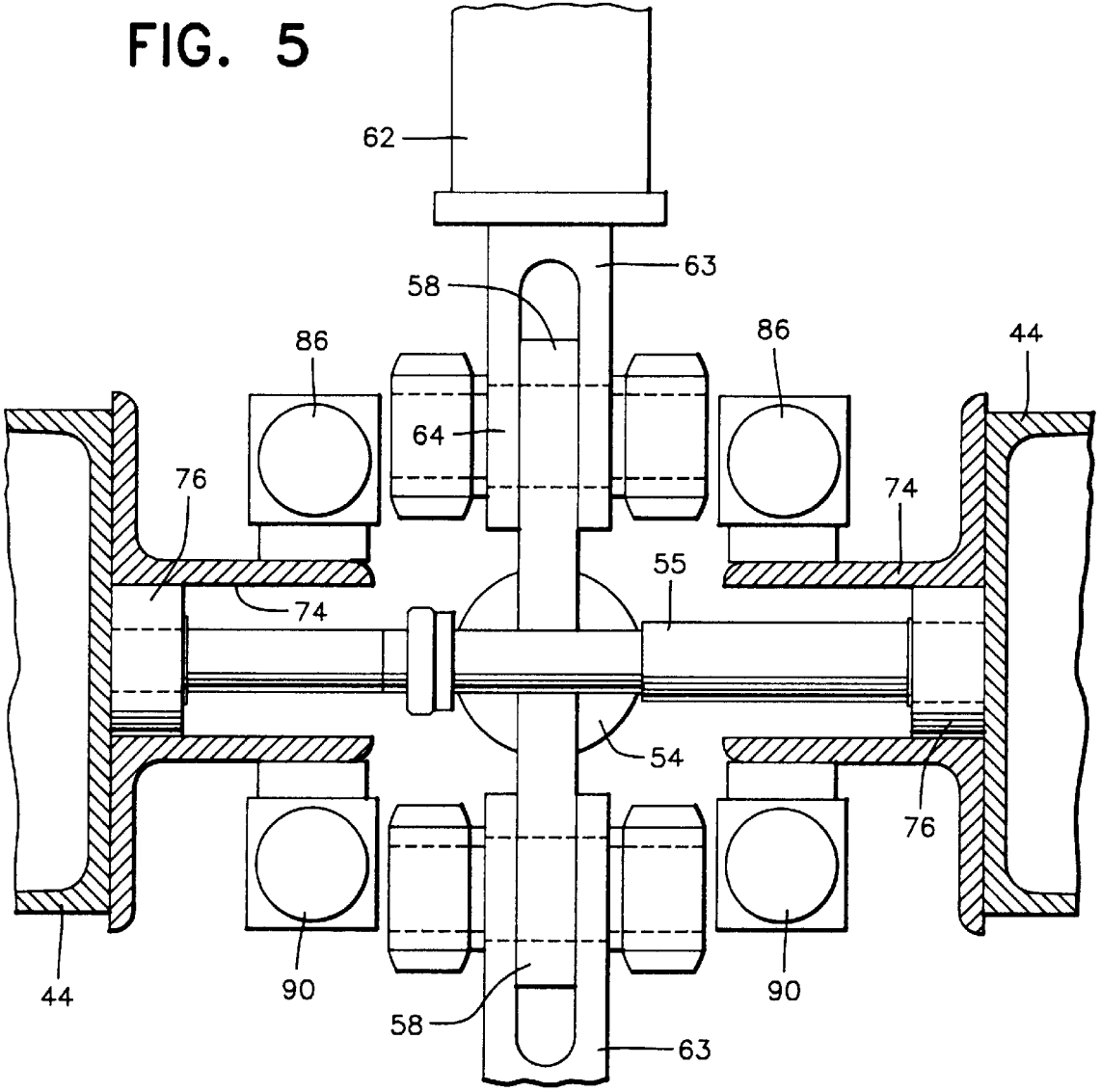
FIG. 5 is a transverse, sectional view on an enlarged scale, along section line 5—5 illustrating further structural details of the hydraulically operated mechanism for moving the compacting members and actuating the closure plates for the inlet and outlet of the compaction chambers.

The supply bin 12 includes a peripheral wall 22 oriented vertically and including an inverted V-shape central baffle 24 which combines with the generally rectangular peripheral wall 22 to define a pair of horizontally spaced, vertically disposed soil discharge areas 26. Each of the compaction chambers 14 includes a pair of parallel side walls 28 oriented vertically and extending horizontally in spaced parallel relation to each other as illustrated in FIG. 2. The side walls 28 are interconnected by an end wall 30 perpendicular to the side walls 28 and rigidly affixed thereto as illustrated in FIGS. 1–3. The top of the compaction chamber 14 includes an inlet opening 32 and the bottom of the compaction chamber 14 includes an outlet opening 34. The openings 32 and 34 are vertically aligned with the inlet opening 32 being in communication with the discharge area 26 for supplying soil 36 to be compressed into the compaction chamber 14 so that the compacting member 16 can compact the soil into a solid block that can be discharged from the outlet 34 after it has been compressed. The vertical orientation of the inlet and outlet enables gravity flow of soil into the compaction chamber 14 and gravity discharge of the blocks from the outlet 34 of the compaction chamber onto a conveyor or other structure to collect the blocks for use.

The top of the compaction chamber is closed by a sliding plate 38 and the outlet 34 is closed by a sliding plate 40 which are horizontally received in and guided by grooves 42 in the side plates 28 with the distal end of the plates being received in grooves 50 in the end wall 30 as illustrated in FIGS. 2 and 3.

Each of the compacting members or rams 16 includes a piston or ram 52 slidable in the compaction chamber between the side plates 28 and between the closure plates 38 and 40 as illustrated in FIGS. 1–4. The piston 52 is connected to an elongated rod or bar 54 that extends longitudinally of the structure defining the compaction chambers 14 and centrally between longitudinal frame members 44 which interconnect the compaction chambers 14 and supports the bin 12. The rods 54 are connected to the respective pistons 52 by a transverse pin or bolt 56. The end of the rod 54 remote from the piston 52 is provided with a pair of opposed lugs or brackets 58 rigid therewith with the brackets extending vertically from the top and bottom of the rod 54 as illustrated in FIG. 1. The brackets 58 are associated with the leverage system 20 in a manner to reciprocate the piston 52 upon actuation of the hydraulic assembly 18. The leverage system 20 is oriented symmetrically above and below the longitudinal center of the earth block machine in generally vertical alignment.

Each leverage system includes a pair of links 60 and 62. Each of the links 60 and 62 has a bifurcated end 63 pivotally connected to the brackets or lugs 58 by a pivot pin 64. The ends of the links 60 and 62 remote from the lugs 58 are positioned in overlying relation to each other and are connected to a piston rod 66 extending from a hydraulic cylinder 68 by a pivot pin 70. The hydraulic assembly illustrated includes a pair of hydraulically powered piston and cylinders oriented in transverse, generally perpendicular relation to the longitudinal axis of the compaction chambers 14 and the compacting members 16. As the piston rods 66 are extended and retracted, the links 60 and 62 of each leverage system 20 will move from an outwardly converging acute angular relation as illustrated in FIG. 1 to a generally aligned relation as illustrated in FIG. 3 thereby causing the piston or ram 52 to move outwardly toward the end wall 30 of the compaction chamber 14 to compress the soil 36 as illustrated in FIG. 1 into a solid soil block 72 as illustrated in FIG. 3.

Each of the compression rods or bars 54 connected to the pistons or rams 52 has its inner end guided by a pair of opposed guide surfaces 74 supported from frame 44 engaged by rollers 76 journalled on the end of an axle or shaft 56 rigid with the rod or bar 54. The rollers 76 engage the guide surfaces 74 to guide and stabilize the end of the rod 54 remote from the piston 52 during its reciprocation between the positions illustrated in FIGS. 1 and 3 thus stabilizing the longitudinal movement of the bar 54 and maintaining the piston 52 in appropriate alignment with the side walls 28 and the plates 38 and 40 for relative sliding movement of the piston 52 in the compaction chamber 14.

The hydraulic cylinders 68 are supported for pivotal movement by trunnions 78 which extend outwardly and are journalled in sockets 80 in a side frame structure 46 extending from frame 44 which enables the piston and cylinder assemblies to rock slightly or pivot slightly when the amount of soil 36 in one of the compaction chambers or molds 14 is greater than in the other thus enabling the soil in the opposed compaction chambers to be equally compressed and enable the piston and cylinder assemblies to compensate for the different volumes of soil in the compaction chambers.

When it is desired to adjust the spacing of the piston 52 in relation to the end wall 30, an adjustable stopper 82 is provided to regulate the effective length of extension of the piston rod 66 when pressure is supplied to the piston and cylinder assembly.

The top plate 38 on each of the compaction chambers 14 has its inner end connected to a piston rod 84. The piston rods 84 extend into a hydraulic cylinder 86 with a piston on the inner end of each piston rod in a conventional manner so that when pressure is supplied to or exhausted from the cylinder 86, the plates 38 will be moved outwardly simultaneously to the closed position or inwardly to an open position by being moved inwardly toward each other. Likewise, the bottom plates 40 which close the outlet 34 are connected to piston rods 88 which are received in a cylinder 90 with the pistons in the cylinder 90 being extended or retracted as the hydraulic pressure is supplied to or exhausted from the cylinder 90 in a well known manner. This structure enables the closure plates 38 and 40 to be operated in a manner to open the upper plates 38 after compacted blocks have been discharged and the bottom plates 40 closed. This will admit the soil 36 into the compaction chambers after which the upper plates 38 are closed and the pistons or rams 52 are moved outwardly to compress and compact the block 72. After compaction, the bottom plates 40 are retracted along with the piston or ram 52 so that the compacted block 72 will be discharged by gravity onto a conveyor to move the finished block to a position of use or storage. The bottom plates 40 are then closed and the top plates 38 opened while the piston 52 remains retracted so that soil can fill the compaction chamber by gravity after which the top plates 38 are closed and the pistons 52 extended and moved toward the end plates 30 for compacting the blocks.

In this machine which is hydraulically operated, the soil will be compressed at a very high pressure until it becomes a solid block. The machine is symmetrical, excluding the bin 12, with respect to the common axis of the vertically oriented cylinders 68 and about the longitudinal axis of the compaction chambers 14 and the path of movement of the compacting members 16. In FIG. 1, the earth block forming machine is at the beginning of the cycle with the cylinder 86 retracting the plates 38 thus permitting the soil in the bin to fall onto the bottom plates 40 which are in closed position. When the compaction chamber or mold is filled with soil, the top plates 38 are returned to their closed position and the piston rods 66 are moved towards each other with the pins 70 also moving towards each other. The ends of the links 60 and 62 connected to the lugs 58 are moved away from each other in a horizontal direction with the pistons 52 thus being moved outwardly by the piston rods or bars 54. The illustration in FIG. 3 shows the final position of the components when the soil has been compacted into earth blocks 72. After the earth blocks have been compressed, the plates 40 and pistons or rams 52 are retracted after a small time delay and as the plates 40 are fully retracted, the blocks drop onto a conveyor and are removed. Inasmuch as it is difficult to have the exact same amount of soil in each of the compaction chambers or molds and to exert the exact same hydraulic pressure on each of the vertical cylinders, the vertical cylinders 68 are trunnion mounted on pin 78. This allows the cylinders 68 to oscillate and the pins 70 to move arcuately horizontally to compensate for the different volumes of soil in the compaction chambers depending upon the quantity of the soil. Also depending upon the quality of the soil, the distance of the piston 52 and its adjacency to the end plate 30 of the compaction chamber can be changed by use of the adjustable stopper 82 which regulates the rod reaction of the vertical hydraulic cylinders 68.

When the piston rods 66 of hydraulic cylinders 68 reach their maximum extension, the position of the links 60, 62 is almost horizontal, about 5° from horizontal alignment as illustrated in FIG. 3. The force P of the hydraulic cylinders have two equal components: T is transmitted to the piston rods or bars 54 by means of the pins 64. The horizontal component of force component T is H. H compresses the soil in the mold. Note that the total force compressing the soil in the compaction chamber 14 is 2H. The vertical component of force component T is V acting on pin 64 of the top links is elided by the vertical component V of the force component T acting on the lower links.

The movement of piston rod or bar 54 is restrained along a horizontal axis by guide rollers 76.

$V=T \cdot \sin\alpha$, where $\alpha$ is the angle formed by the link with horizontal.

Also, $P/2=H \cdot \tan\alpha$.

When forming a 12"×10"×4" block or brick, the required force 2H to produce a pressure of 3,000 psi is 144,000 lbs. Therefore, H is 72,000 lbs.

$P=2 \cdot 72{,}000 \cdot \tan\alpha=144{,}000 \tan 5°=12{,}598$ lbs.

A 6" bore hydraulic cylinder has a cross area of: 28.26 $in^2$. The pressure to generate above load is:

P=12,598/18.26=446 psi

A 5" bore hydraulic cylinder has a cross area of 19.625 $in^2$. and

P=12,598/19.625=692 psi

A 4" bore hydraulic cylinder has a cross area of 12.56 $in^2$ and

P=12,589/12.56=1002.3 psi

Theoretically there is no vertical force on piston rod or bar 54, making its motion easy. The size of the selected hydraulic cylinder is a 5" bore. Since a 750 psi hydraulic fluid pressure is used, the load required is easily obtained.

The machine is perfectly symmetric with respect to the hydraulic cylinder axes and includes a left side mold and a right side mold. The soil enters the mold or soil chambers by gravity through the discharge areas 26 in bin 12. The compression is done by the rams or pistons 52, which are connected to the compressing bars 54. When the hydraulic cylinders 68 extend the piston rods 66 and the link ends 63 move outwardly in opposite directions, the two soil compressing rams or pistons 52 move in the same direction. The soil is compressed up to 3000 psi and becomes solid as rams or pistons 52 reach the end of their travel.

To remove the blocks 72, the bottom plates 40 are slid inward, allowing the block to fall on a belt conveyor (not shown) The pistons 52 move inward at the same time. When the lower plates 40 closes the outlet and the hydraulic cylinders 86 and piston rods 84 retract and top plates 38 retract inwardly, leaving an opening for the soil to drop onto the lower plates 40. the position of the top plate controls the soil quantity needed to form the right size block.

The compressing bar 54 is guided in its motion by two opposed guide surfaces 74 nd two rollers 76. The high compression load on the soil is reached when the links 60 and 62 reach an almost horizontal position as shown in FIG. 3.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. An earth block machine comprising a pair of aligned opposed molds oriented in spaced relation, each of said molds having an inner open end and an outer closed end, compacting members reciprocally mounted in said molds, each of said molds including an inlet for soil and an outlet for a compressed earth block, said inlet and outlet being in aligned vertically spaced relation for gravity flow of soil into the mold and gravity discharge of compressed earth blocks, an openable closure for each said inlet, an openable closure for each said outlet, a power structure oriented generally between said molds, said power structure being connected to each of said compacting members through said inner open end by a force increasing leverage system providing compacting force to said compacting members.

2. The earth block machine as defined in claim 1 wherein said leverage system connected to each compacting member includes a pair of diverging links having proximal ends connected to the power structure, said links having their distal ends spaced apart and pivotally connected to said compacting members, said power structure moving said proximal ends of said links toward a position aligned with the distal ends when the power structure exerts force on said links to move the compacting members toward the closed ends of the molds to compact soil into compressed blocks.

3. The earth block machine as defined in claim 2 wherein said power structure includes a pair of fluid pressure operated piston and cylinder assemblies oriented in opposed generally aligned relation, each of said piston and cylinder assemblies having a piston rod pivotally connected to the proximal end of said pair of diverging links with extension and retraction of the piston rods causing reciprocation of the compacting members.

4. The earth block machine as defined in claim 3 wherein each of said pressure operated piston and cylinder assemblies is operated by hydraulic pressure.

5. The earth block machine as defined in claim 1 wherein said openable closures for the inlet and outlet for each mold is a reciprocally sliding plate, said plates being movable between open and closed position by linear movement generally parallel to the movement of the compacting members.

6. The earth block machine as defined in claim 5 wherein each of said plates is connected to a piston and cylinder for movement between open and closed positions.

7. The earth block machine as defined in claim 3 wherein said piston and cylinder assemblies are aligned and mounted for pivotal movement about an axis transverse of the piston and cylinder assemblies to enable arcuate movement of the connection between the piston rods and links.

8. The earth block machine as defined in claim 3 wherein said openable closures for the inlet and outlet for each mold is a reciprocally sliding plate, said plates being movable between open and closed position by linear movement generally parallel to the movement of the compacting members.

9. The earth block machine as defined in claim 8 wherein each of said plates is connected to a piston and cylinder for movement between open and closed positions.

10. A hydraulically powered earth block forming machine comprising a generally vertical soil supply bin, a generally horizontally disposed compaction chamber below said bin and in communication therewith for gravity flow of soil from the bin into the compaction chamber, a movable plate defining an upper wall for said compaction chamber and selectively closing a flow path for soil into the compaction chamber, a reciprocal ram mounted in said compaction chamber for compressing soil in the compaction chamber into an earth block, said compaction chamber including an openable and closeable outlet for discharge of compressed earth blocks from the compaction chamber, an actuating bar connected to said ram, a linkage mechanism connected to said actuating bar, a piston rod and cylinder mounted in generally perpendicular relation to said actuating bar, said piston rod being pivotally connected to and actuating said linkage mechanism, said linkage mechanism including a link movable between a position substantially in alignment with the actuating bar when the piston rod is extended to exert maximum force on the ram to move the ram to soil compressing position and a position in acute angular relation to the path of movement of the actuating bar when the piston rod is retracted to move the ram to retracted position.

11. The earth block forming machine as defined in claim 10 together with a support frame rigidly supporting said compaction chamber, said frame including guide means engaging said actuating bar in spaced relation to said compaction chamber to maintain straight line movement of said actuating bar and its connection to said link.

12. The earth block forming machine as defined in claim 11 wherein said actuating bar includes a roller on the end thereof remote from said ram, said guide means including a guide surface on said frame engaged by said roller.

13. The earth block forming machine as defined in claim 10 wherein said outlet is located below said ram and a movable plate selectively opening and closing said outlet to enable gravity discharge of compressed earth blocks.

14. The earth block forming machine as defined in claim 13 wherein said movable plates are reciprocally mounted in the compaction chamber for movement parallel to the ram, and a hydraulically operated piston and cylinder connected to said reciprocal plates for movement independent of each other and independent of the ram.

15. The earth block forming machine as defined in claim 14 together with a support frame rigidly supporting said compaction chamber, said frame including guide means engaging said actuating bar in spaced relation to said compaction chamber to maintain straight line movement of said actuating bar and its connection to said link.

16. The earth block forming machine as defined in claim 15 wherein said actuating bar includes a roller on the end thereof remote from said ram, said guide means including a guide surface on said frame engaged by said roller.

17. The earth block forming machine as defined in claim 10 together with a second compaction chamber, ram and actuating bar oriented in opposed relation to the compaction chamber, ram and actuating bar defined in claim 10, said second compaction chamber being in communication with said bin, a second movable plate defining an upper wall for said second compaction chamber and selectively closing a flow path from said bin to said second compaction chamber, said second compaction chamber including an openable and closeable outlet for discharge of compressed earth blocks, said linkage mechanism including a second link with one end pivotally connected to said second actuating bar, said piston rod being pivotally connected to an opposite end of said second link to move said links from acute angular relation to each other to substantially aligned relation for increasing force exerted on the opposed rams as the links approach aligned relation.

18. The earth block forming machine as defined in claim 17 wherein said bin includes an inverted V-shaped baffle defining a pair of discharge areas associated independently with said compaction chambers.

19. The earth block forming machine as defined in claim 17 together with a second piston rod and cylinder mounted in opposed relation to the piston rod and cylinder defined in claim 17, a second actuating bar connected to each of said rams, a second linkage mechanism including a pair of additional links each having one end pivotally connected to one of said second actuating bars, said second piston rod being pivotally connected to an opposite end of each said pair of additional links, said pair of additional links being moved between acute angular relation to each other and to the path of movement of said second actuating bars and generally aligned relation to said second actuating bars with the force exerted on the rams increasing as the links approach aligned relation.

20. A hydraulically powered earth block forming machine comprising a generally vertical soil supply bin, a generally horizontally disposed compaction chamber below said bin and in communication therewith for gravity flow of soil from the bin into the compaction chamber, a movable plate defining an upper wall for said compaction chamber and selectively closing a flow path for soil into the compaction chamber, a reciprocal ram mounted in said compaction chamber for compressing soil in the compaction chamber into an earth block, said compaction chamber including an openable and closeable outlet for discharge of compressed earth blocks from the compaction chamber, an actuating member connected to said ram, a leverage mechanism connected to said actuating member, a hydraulically actuated piston and cylinder assembly connected to said leverage mechanism with the force exerted on the ram increasing as the leverage mechanism is actuated.

21. A machine for compressing a compressible material comprising a supply of compressible material, a compaction chamber receiving compressible material from said supply, said compaction chamber including an openable and closeable inlet and outlet for introducing compressible material into said compaction chamber and discharge of compressed material from said compaction chamber, a reciprocal ram mounted in said compaction chamber for compressing compressible material in the compaction chamber, a reciprocal actuating member connected to said ram, a leverage mechanism connect to said actuating member, a fluid pressure actuated piston and cylinder assembly connected to said leverage mechanism, said piston and cylinder assembly including a reciprocal piston, said leverage mechanism including a link pivotally connected to said actuating member and said piston, said link being movable between a position in acute angular relation to the path of movement of the actuating member and a position substantially in alignment with the actuating member when the piston is reciprocated to exert increasing compressive force on said ram as said link approaches alignment with said actuating member.

* * * * *